US005575709A

United States Patent [19]

Hertelendi et al.

[11] Patent Number: 5,575,709

[45] Date of Patent: Nov. 19, 1996

[54] RAIL GRINDING MACHINE FOR GRINDING RAILS OF A TRACK

[75] Inventors: Josef Hertelendi, Freilassing; Sebastian Kreuzeder, Ainring; Bruno Strobl, Unterhaching, all of Germany

[73] Assignee: Franz Plasser Bahnbaumaschinen-Industrieges.m.b.H., Vienna, Austria

[21] Appl. No.: 377,367

[22] Filed: Jan. 24, 1995

[30] Foreign Application Priority Data

Feb. 1, 1994 [AT] Austria ..... 180/94

[51] Int. Cl.[6] ..... B24B 23/00; B24B 27/08

[52] U.S. Cl. ..... 451/347; 451/344; 451/429

[58] Field of Search ..... 451/347, 429, 451/439, 344

[56] References Cited

U.S. PATENT DOCUMENTS

| | | | |
|---|---|---|---|
| 1,887,424 | 11/1932 | Perazzoli | 451/347 |
| 1,891,173 | 12/1932 | Perazzoli | 451/347 |
| 1,973,429 | 9/1934 | Cooney | 451/429 |
| 2,047,591 | 7/1936 | Mall | 451/429 |
| 2,106,034 | 1/1938 | Mall | 451/347 |
| 2,118,621 | 5/1938 | Perazzoli | 451/429 |
| 2,148,766 | 2/1939 | Mall | 451/347 |
| 2,324,263 | 7/1943 | Lowe | 451/347 |
| 3,154,892 | 11/1964 | Kruger | 451/347 |
| 3,205,623 | 9/1965 | Clayborne et al. | 451/347 |
| 4,492,059 | 1/1985 | Panetti | 451/347 |
| 4,862,647 | 9/1989 | Vieau | 451/347 |

*Primary Examiner*—D. S. Meislin
*Assistant Examiner*—Derris Banks
*Attorney, Agent, or Firm*—Henry M. Feiereisen

[57] ABSTRACT

A rail grinding machine for grinding rails of a track includes a machine frame with rollers for support on both rails of the track and a swivel drive for swingably mounting a carrier frame to the machine frame for rotation about a pivot axis which extends longitudinally in direction of the track. A grinder is adjustably secured to the carrier frame in an area of one rail, with a drive motor for supplying energy to the swivel drive and the grinder being secured to the machine frame at an area distant to the carrier frame. The distance of the carrier frame and its pivot axis from a support roller located opposite to the grinder is reducible by a length compensation unit which includes a pressure-exerting element for applying in opposition to the distance reduction a force by which the grinder is pressed against a rail head inner flank of the rail being ground.

24 Claims, 3 Drawing Sheets

Fig.1
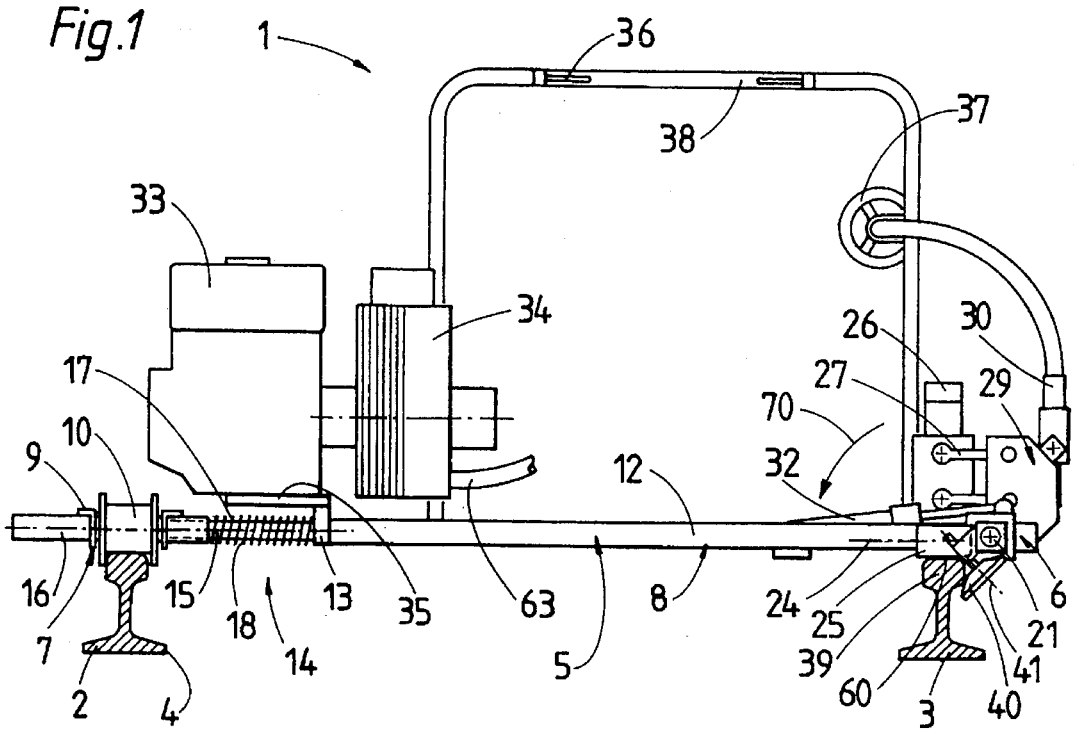
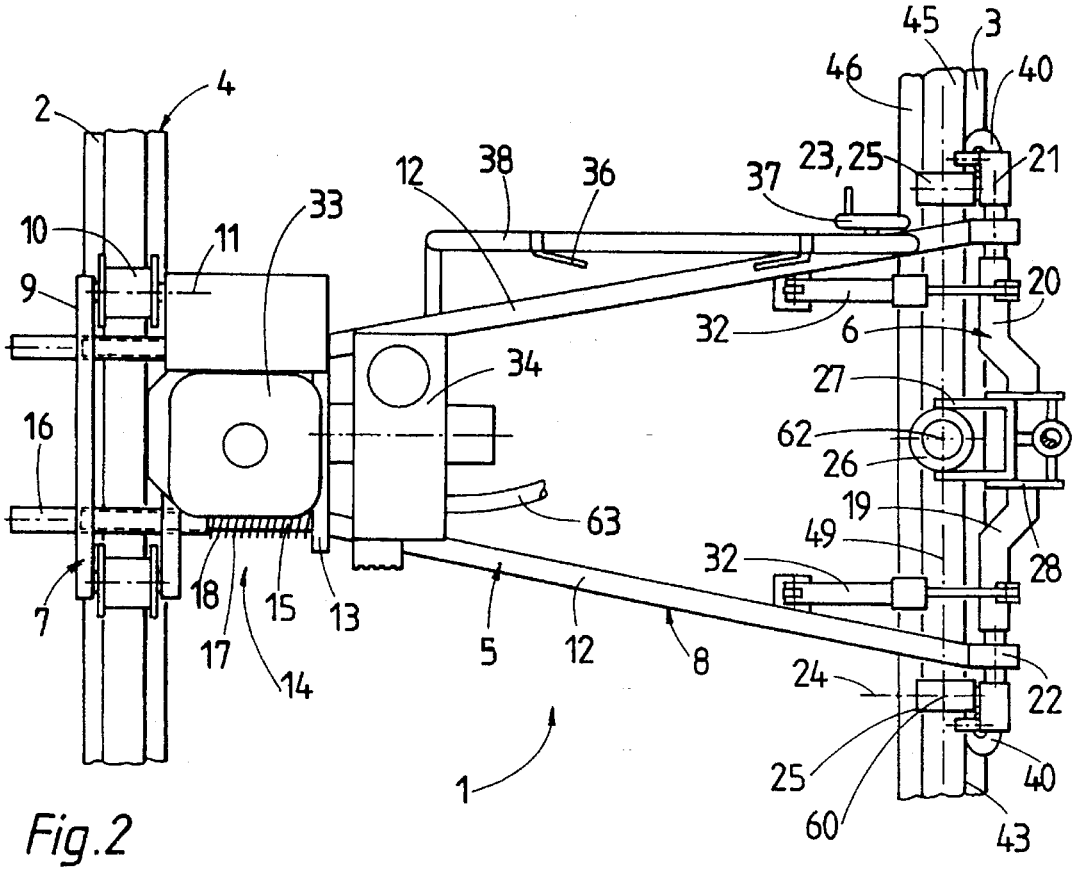
Fig.2

Fig.4
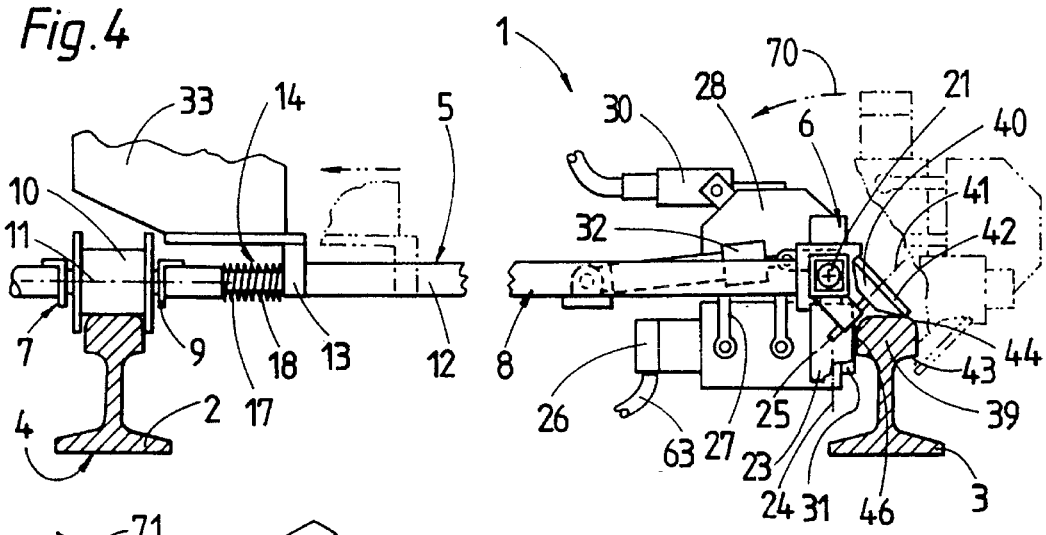
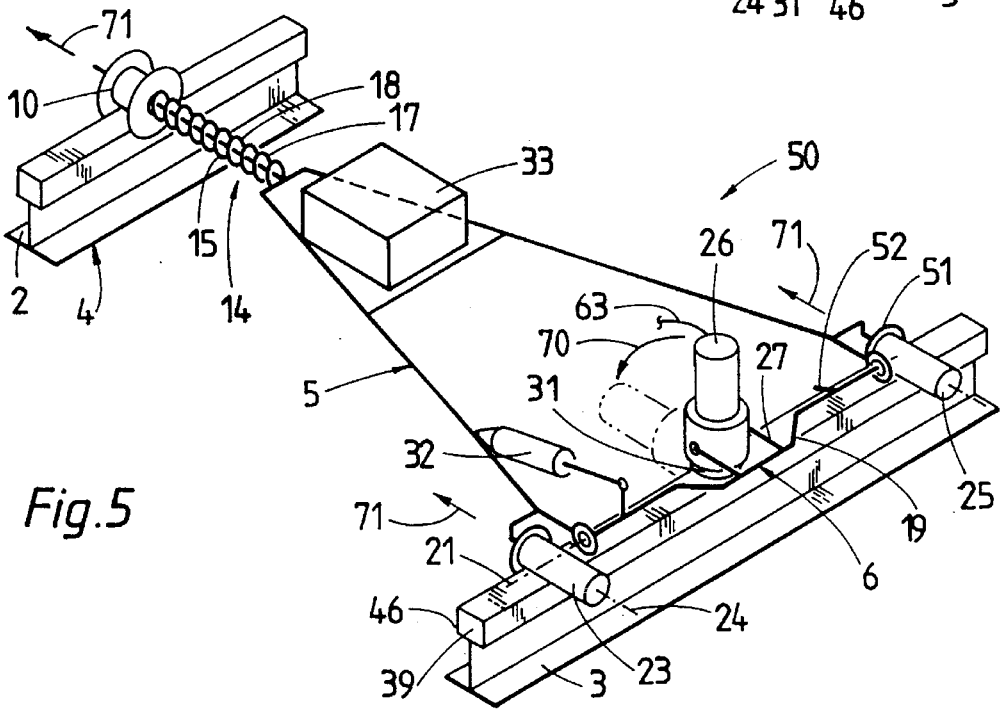
Fig.5
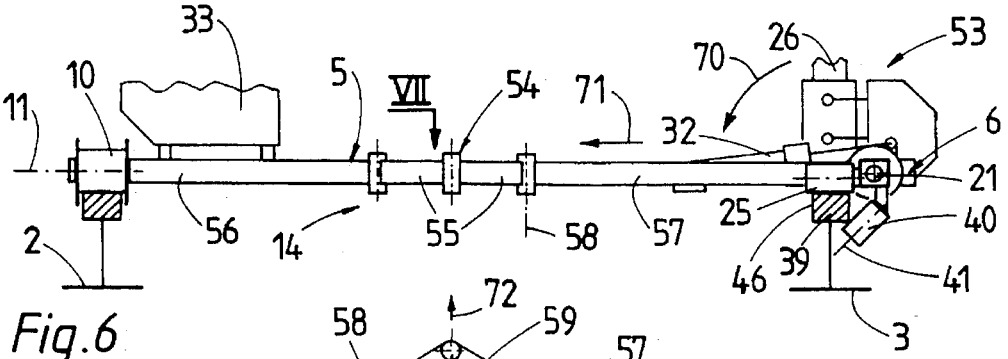
Fig.6
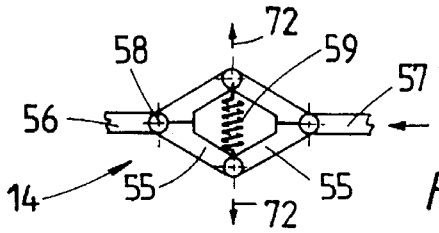
Fig.7

RAIL GRINDING MACHINE FOR GRINDING RAILS OF A TRACK

BACKGROUND OF THE INVENTION

The present invention refers to a rail grinding machine for grinding rails of a track, and in particular to a rail grinding machine of a type having a machine frame supported by rollers for mobility on both rails and associated with a grinder adjustably secured to a carrier frame in the area of one rail, with the carrier frame together with the grinder being swingably mounted to the machine frame for rotation about a pivot axis, and further including a drive motor which is secured to the machine frame at an area distant to the carrier frame.

Such grinders are used to profile or smooth the rail, in particular the running surfaces and running edges of railways for eliminating surface imperfections on the rail head caused by wear or experienced after welding operations.

The publication "Progressive Railroading", April 1981, page 11, discloses a grinder which includes a machine frame supported on rollers for mobility along the track. The machine frame includes a carrier frame in the area of one of the rails for carrying the grinder in form of a grinding wheel. A lever unit forms a swivel drive to allow an angular adjustment of the grinder longitudinally in direction of the rail. The motor or the power plant for the grinder is situated at a distance to the grinder at the other side of the machine frame and is operatively connected with the grinder via a flexible shaft. A grinder of this type is useable only for grinding the running surfaces of the rails.

European Patent No. EP 0 110 246 B1 describes a rail grinding machine with a machine frame supported on rollers for mobility along the rails. A carrier frame is arranged in the area of one of the rails and tiltable by means of a jib-like spindle drive about a pivot axis which extends longitudinally in direction of the track, with the spindle drive being articulated to the machine frame. Secured to the carrier frame is a motor-driven abrasive belt unit which is provided with a vertically adjustable bearing roller and is additionally swingable about a vertical axis relative to the carrier frame.

The publication "Railway Track and Structures", April 1993, page 2, discloses a rail grinder in which the carrier frame is secured upon a machine frame via guides which extend transversely to the track for allowing an adjustment of the carrier frame in transverse direction. The grinder is swingably mounted to the carrier frame about a pivot axis which runs parallel to the rail, with the feed of the grinder being readjusted perpendicular to the rail after each tilting and transverse displacement.

Further conventional rail grinders are known which roll on only one rail of the track and include a carrier frame for attachment of a motor-driven grinder. The carrier frame directly bears via support rollers upon the rail and thus must be held in balance by an operator during operation. For grinding lateral rail head edges and areas, the grinder is tilted in direction transversely to the track, with supporting rollers or guide rollers preventing a slipping of the grinder from the rail head.

SUMMARY OF THE INVENTION

It is an object of the present invention to provide an improved rail grinding machine obviating the aforestated drawbacks.

In particular, it is an object of the present invention to provide an improved rail grinding machine by which the rail tread as well as the inside running edges of the rails can be ground without any problem at a minimum of structural elements.

These objects and others which will become apparent hereinafter are attained in accordance with the present invention by incorporating in the machine frame a length compensation unit which allows a reduction of the distance of the carrier frame and its pivot axis extending longitudinally in direction of the track, from a support roller which is situated in opposition to the grinder in a direction transversely to the track, with the length compensation unit including a pressure exerting element for applying in opposition to the distance reduction a force by which the grinder is pressed against an inner rail head flank of the rail being ground.

Through the provision of a rail grinding machine according to the present invention, it is now possible for the first time to automatically apply a necessary force for pressing the grinder against the inner rail flanks during grinding operation without putting any muscle strain on the operator or requiring any complicated control systems. In a constructively most simple manner, a swinging of the grinder to the inside rail head flank effects a shortening of the machine frame in a direction transversely to the track and at the same time a tensioning of the pressure-exerting element for generating the desired force against the grinder. The rail grinding machine according to the invention thus not only increases the quality of the work but greatly simplifies the operation and reduces the strain upon the operator.

At maximum distance between the carrier frame and the opposing support roller, the pivot axis of the carrier frame suitably extends outside the one rail being ground at a distance from an upper outer rail head edge in horizontal and vertical directions. In this manner, a greatest possible transverse movement of the carrier frame and thus distance reduction of the grinder towards the opposing rail is ensured, resulting in a gradual built-up of the required pressing force during shift of the pivot axis in direction of the inside rail head flank.

Those rollers which support the machine frame on the rail being ground are suitably secured directly to the carrier frame and rotate about an axis of rotation which extends perpendicular to the longitudinal direction of the track and to the horizontal pivot axis of the carrier frame. Preferably, the grinder bears upon the rail at a point of contact which lies on a connecting line between roller contact points formed by a contact of the rollers upon the rail being ground. Thus, the support rollers assume the function of track rollers by which the grinder is guided relative to the rail head at a correct distance which is maintained also during tilting of the carrier frame about the pivot axis which extends longitudinally in direction of the track. In this manner, shod-wave surface imperfections of the rail are not copied or reinforced by the grinder.

According to another feature of the present invention, the machine frame is composed of two frame structures which are connected together via the length compensation unit and adjustable relative to each other in direction transversely to the track. The length compensation unit preferably includes a support member which extends in direction transversely to the track and is attached to one frame structure of the machine frame while being adjustable in longitudinal direction relative to the other frame structure. Preferably, the pressure-exerting element of the length compensation unit is a helical spring which is arranged between both frame structures and is compressed during shortening of the machine frame across the track when preparing the grinder for machining the inside rail head flank through suitably swinging the carrier frame about the pivot axis. A length compensation unit of this type is thus characterized by a simple structure and yet is reliable and highly effective.

In order to prevent the carrier frame from slipping off the rail head through gravitational forces when the grinder and the carrier frame are tilted transversely to the track at a maximum for grinding the inside rail head flank, each track roller is associated to a guide roller which is secured to the carrier frame and rotatable about an axis which extends at an angle to the axis of rotation of the associated track roller and perpendicular to the pivot axis of the carrier frame. Suitably, each guide roller has a rim for bearing on an outer rail head edge at a distance to the associated track roller. Preferably, the axis of rotation of the track roller and the axis of the guide roller define an angle of 45°.

The grinder is advantageously equipped with a remote-controlled actuating drive for adjusting the grinder towards the rail being ground so as to increase the operating comfort and to improve the overall ergonomics of the rail grinding machine. Control elements for the drive motor, by which energy is supplied to the swivel drives and the grinder, and for the grinder itself are preferably mounted on a U-shaped stand which projects upwardly from the machine frame for easy reach by the operator. This feature further simplifies the operation and increase the convenience for the operator.

BRIEF DESCRIPTION OF THE DRAWING

The above and other objects, features and advantages of the present invention will now be described in more detail with reference to the accompanying drawing in which:

FIG. 1 is a schematic end view in longitudinal direction of the track of one embodiment of a rail grinding machine according to the present invention;

FIG. 2 is a top view of the rail grinding machine of FIG. 1;

FIG. 4 is a simplified fragmentary end view of the rail grinding machine of FIG. 1 in longitudinal direction of the track, illustrating in detail two end positions of the grinding unit relative to the rail being ground;

FIG. 5 is a perspective, schematic illustration of another embodiment of a rail grinding machine according to the present invention;

FIG. 6 is a perspective, schematic illustration of yet another embodiment of a rail grinding machine according to the present invention; and FIG. 7 is a fragmentary plan view of a length compensation unit of the rail grinding unit of FIG. 6, taken in direction of arrow VII in FIG. 6.

DETAILED DESCRIPTION OF PREFERRED EMBODIMENTS

Figure 3:
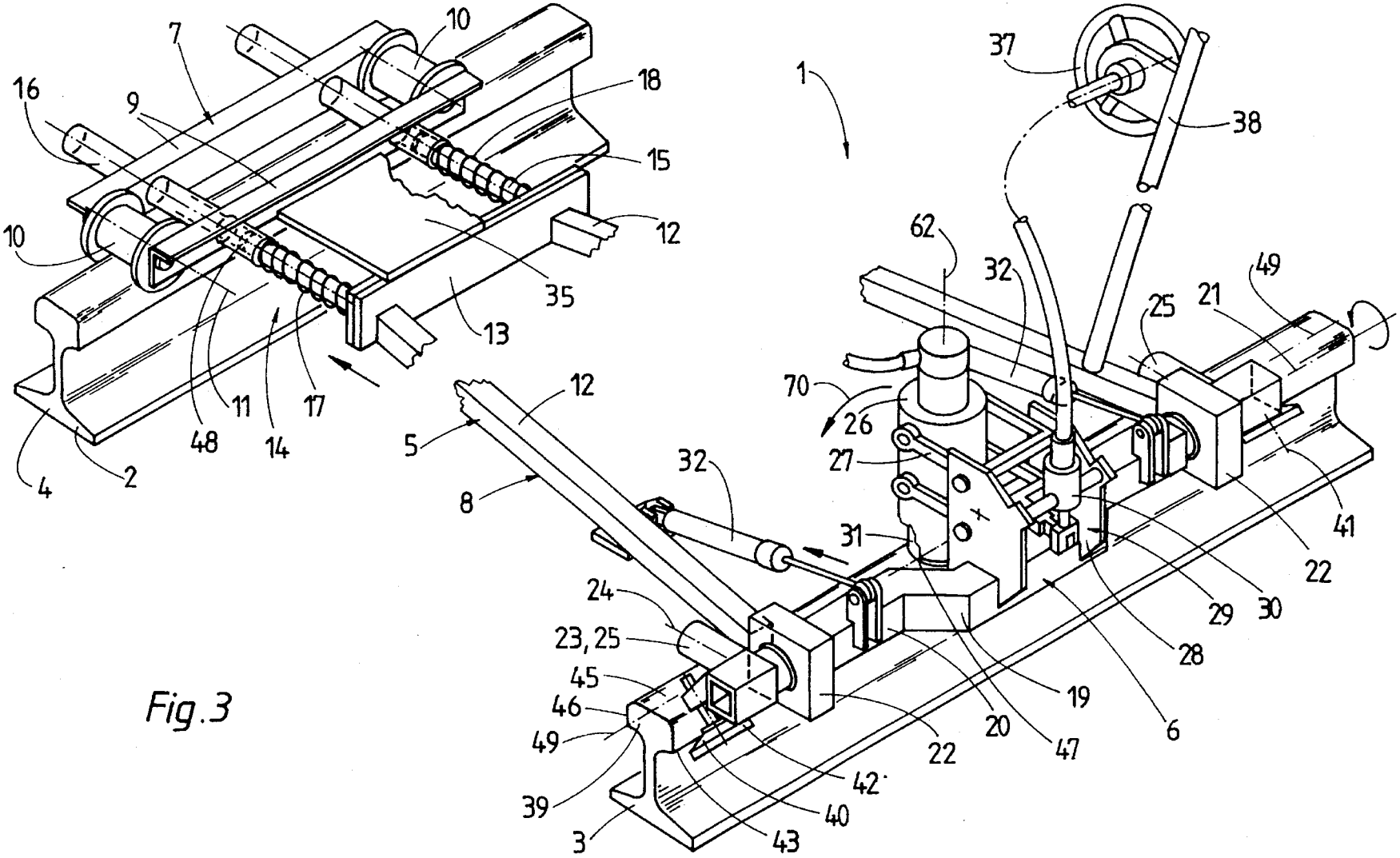
FIG. 3 is a perspective illustration of the rail grinding machine of FIG. 1, with parts of the rail grinding machine being omitted for better illustration.

Throughout all the Figures, the same or corresponding elements are always indicated by the same reference numerals.

Turning now to the drawing, and in particular to FIG. 1, there is shown a schematic end view of one embodiment of a rail grinding machine according to the present invention, generally designated by reference numeral 1 for grinding rails 2, 3 of a track 4, with the rails 2, 3 being of conventional girderlike configuration with a rail head 39. In the nonlimiting example of FIG. 1, rail 3 is selected for grinding operation.

The rail grinding machine 1 includes a machine frame, which is generally designated by reference numeral 5 and extends across the track 4, and a carrier frame, which is generally designated by reference numeral 6 and extends longitudinally in direction of the track 4. In the area of the rail 3, the carrier frame 6 is connected with the machine frame 5, as will be described furtherbelow.

The machine frame 5 includes two frames structures, generally designated by reference numerals 7, 8, with frame structure 7 being associated to rail 2 and frame structure 8 being associated to rail 3.

As can be seen from FIGS. 2 and 3, which are a top view and a perspective illustration of the rail grinding machine 1, respectively, the frame structure 7, which opposes the carrier frame 6 at a distance thereto and extends longitudinally in direction of the rail 2, includes two angled plates 9 which are in parallel relationship to the rail 2 and carry therebetween at their axial ends a support roller 10 in form of double-flanged wheels with pivot axis 11 for mobility on the rail 2. The frame structure 8 includes two crossbars 12 which extend slantingly substantially across the track 4 and are spaced apart longitudinally in direction of the track 4. The ends of the crossbars 12 near the rail 2 are connected in a stable manner by means of a vertical plate 13 situated between the rails 2, 3.

The linkage of both frame structures 7,8 is accomplished by a length compensation unit, generally designated by reference numeral 14 and allowing a relative adjustment of both frame structures 7, 8 to each other in a direction transversely to the track 4. The length compensation unit 14 is formed by two support bars 15 which extend transversely to the track 4, with their one end being secured to the plate 13 at the side distant to the frame structure 8. The other end of each support bar 15 is received and nested in a guide tube 16 which is secured in the parallel angle plates 9. Thus, the support bars 15 can shift in a telescopic manner relative to the guide tubes 16. Arranged over each support bar 15 between the guide tube 16 and the plate 13 is a pressure-exerting element 17 in form of a helical spring 18 by which both frame structures 7, 8 are spread in transverse direction of the track 4 when the carrier frame 6 occupies the one end position shown in FIGS. 1 to 3. Suitably, a stop 48 (FIG. 3) is located inside of each guide tube 16 to restrict this spreading motion and to prevent a separation of the frame structures 7, 8.

The carrier frame 6 includes essentially a longitudinal beam 20 with a gooseneck-type central section 19 so as to be distanced from the rail 3. Both axial ends of the beam 20 are swingably received in a bearing block 22 for rotation about a pivot axis 21 which extends longitudinally in direction of the track 4 and parallel to the track plane. At their rail-proximate side, the bearing blocks 22 are secured to the facing ends of the crossbars 12 of the frame structure 8. As can be seen from FIGS. 2 and 3, the longitudinal beam 20 of the carrier frame 6 extends beyond the bearing blocks 22 for receiving support rollers 23 which support the carrier frame 6 and the machine frame 5 upon the rail 3. The support rollers 23 are designed as unrimmed track rollers 25, with each track roller 25 rotating about an axis of rotation 24 which extends perpendicular to the pivot axis 21.

Mounted in the gooseneck-type central section 19 of the carrier frame 6 is a grinding unit, generally designated by reference numeral 26 and including a grinder 31 in form of a rotatable cup wheel. The grinding unit 26 is equipped with a hydraulic motor and is connected via a parallel bars link 27 to a mounting, generally designated by reference numeral 29. The mounting 29 includes spaced-apart backing plates 28 which are received in pockets of the carrier frame 6. An actuating drive 30 is secured to the mounting 29 and connected to the parallel bars link 27 for adjusting the position of the grinder 31 relative to the rail 3 and thereby controlling the depth of material removal. Suitably, the actuating drive 30 is operated by remote control.

At operation, the grinding unit 26 is positioned in such a manner that a contact point 47 of the grinder 31 with the rail 3 lies on a connecting line 49 which extends between the two contact points 60, respectively defined by a contact of the track rollers 25 upon the rail 3 being worked on, with the grinder 31 in form of a cup wheel rotating about an axis 62 which runs perpendicular to the connecting line 49 and perpendicular to the longitudinal axis of the rail 3, as best seen in FIG. 3.

A swinging of the carrier frame 6 about the pivot axis 21 between the end positions shown in FIGS. 1–3 and in FIG. 4, respectively, is effected by two hydraulic swivel drives 32 which are articulated with their one ends laterally to the crossbars 12 of the frame structure 8 and with their other ends to the longitudinal beam 20. A drive motor 33 with a hydraulic pump 34 supplies energy to the swivel drives 32 and the grinding unit 26 and rests at a distance to the carrier frame 6 upon a console 35 which is secured to the plate 13 of the machine frame 5. Control elements 36 for the swivel drives 32 and a feed regulator 37 for the remote-controlled actuating drive 30 are mounted on a U-shaped stand 38 which projects upwardly from the frame structure 8 of the machine frame 5. Reference numeral 63 indicates tubes for hydraulic fluids to effect the operation of the swivel drives 32 and the grinding unit 26.

Turning now to FIG. 4, there is shown a simplified fragmentary end view of the rail grinding machine 1 in longitudinal direction of the track 4, illustrating in detail the two end positions of the grinding unit 26 relative to the rail 3, with one end position (corresponding to the end position shown in FIGS. 1 to 3), depicted in dash double-dotted line and allowing a grinding of the running surface 45 of the rail head 39 and the other end position, shown in continuous line and allowing a grinding of the inside rail head flank 46. At actuation of the swivel drives 32, the carrier frame 6 is swung e.g. in direction of arrow 70 from the one end position (shown in dash double-dotted line) to the other end position, with the grinder 31 executing a rolling motion transversely to the track 4 about the rail head 39. During the entire swinging motion of the carrier frame 6, the track rollers 25 remain aligned on the connecting line 49 defined between the contact points 60 of the rollers 25 upon the rail 3 to always maintain a same distance of the grinder 31 from the rail head 39.

In order to eliminate a slipping of the grinding unit 26 from the rail head 39 when the carrier frame 6 occupies the extreme end position shown in continuous line in FIG. 4, a guide roller 40 in form of a ring-shaped wheel is secured to the carrier frame 6 laterally adjacent of each track roller 25, as best seen in FIG. 3. Each guide roller 40 is rotatable about an axis 41 extending at an angle of about 45° to the axis of rotation 24 of the track roller 25 and perpendicular to the pivot axis 21 and is equipped with a rim 42 for bearing upon the rail head 39 in the one end position and upon the outer rail head edge 43 in the other end position, as shown in FIG. 4.

In the one end position shown e.g. in FIGS. 1–3 in which the distance between the frame structures 7, 8 is at a maximum, the pivot axis 21 of the carrier frame 6 extends outside of the rail 3 at a vertical as well as a horizontal distance from the upper outer rail head edge 44. In this end position, the grinder 31 machines the horizontal running surface 45. At actuation of the swivel drives 32 to swing the carrier frame 6 together with the grinding unit 26 in direction of arrow 70 into the other end position as shown in FIG. 4 for grinding the inside rail head flank 46, the pivot axis 21 is necessarily shifted in direction to the opposing support roller 10 so as to extend inside of the rail 3 at a vertical as well as horizontal distance from the upper inner rail head edge. Thus, the pressure-exerting element 17 in form of the helical spring 18 of the length compensation unit 14 becomes compressed so as to counter the distance reduction between the pivot axis 21 and the support rollers 10 and thus to generate a force by which the grinder 31 is laterally pressed against the rail head 39.

Turning now to FIG. 5, there is shown a second embodiment of a rail grinding machine according to the present invention, generally designated by reference numeral 50. The rail grinding machine 50 includes only a one-part machine frame 5 and a carrier frame 6 which is rotatably connected to the machine frame 5 in the area of the rail 3 for rotation about a pivot axis 21 which extends longitudinally in direction of the track 4. The machine frame 5 is supported for mobility along the track 4 by a double-rimmed support roller 10 which rolls on rail 2 and two support rollers 23 in form of track rollers 25 which are secured to the machine frame 5 and roll on rail 3.

Each track roller 25 is provided with an inside rim 51 for bearing upon the inner rail head flank 46 of the rail 3. At its end distant to the carrier frame 6, the machine frame 5 is connected to a length compensation unit 14 which includes a support bar 15 extending transversely to the track 4 and secured on one end to the machine frame 5. The other end of the support bar 15 extends coaxially through the support roller 10, with the pressure-exerting element 17 in form of a helical spring 18 being formed over the support bar 15 between the support roller 10 and the facing end of the machine frame 5. In this manner, the helical spring 18 exerts a force in direction of the three support rollers 10, 25 to press them against the rails 2, 3 for eliminating any track play.

In a same manner as described above in connection with the rail grinding machine 1, the carrier frame 6 of the rail grinding machine 50 has a gooseneck-type central section 19 which is connected to the grinding unit 26 via a parallel bars link 27. The grinder 31 of the grinding unit 26 is perpendicularly adjustable relative to the rail head 39. The carrier frame 6 swings together with the grinding unit 26 about the pivot axis 21 in direction of arrow 70 from the end position indicated in continuous line to the other end position indicated in dash double-dotted line by means of a swivel drive 32 which is articulated to the carrier frame 6 as well as to the machine frame 5.

As further shown in FIG. 5, the carrier frame 6 is additionally provided with a tappet 52 which engages the rail head 39 to effect during the transverse movement of the grinding unit 26 in direction of arrow 70 a transverse shift of the carrier frame 6 and thus of the machine frame 5 in direction towards the rail 2 and towards the support roller 10, as indicated by arrows 71. Thus, the helical spring 18 is compressed to exert a force by which the grinder 31 is pressed against the inner rail head flank 46 of the rail 3.

Turing now to FIG. 6, there is shown a third embodiment of a rail grinding machine according to the present invention, generally designated by reference numeral 53. The rail grinding machine 53 includes a carrier frame 6 which is rotatably connected with the machine frame 5 for rotation about a pivot axis 21 extending parallel to the rail 3. The machine frame 5 includes two frame structures 56, 57 which are connected together at their opposing ends by a joint, generally designated by reference numeral 54, via links 55, with the frame structure 56 extending between the joint 54 and the rail 2 and the frame structure 57 extending between the rail 3 and the joint 54. The frame structure 56, which is thus further distanced from the carrier frame 6, is supported at its joint-distal end by support rollers 10 for mobility upon the rail 2 and carries the drive motor 33 for energy supply to the swivel drive 32 and the grinding unit 26. In similar manner as in the embodiment of the rail grinding machine 1 of FIGS. 1 to 4, the carrier frame 6 is provided with a gooseneck-type central section 19 (not shown in FIG. 6) and carries the adjustable grinding unit 26. Track rollers 25 provide mobility of the carrier frame 6 on the rail 3.

In contrast to the embodiment of the rail grinding machine 1, the guide rollers 40 adjacent the track rollers 25 resemble the track rollers 25 and are of drum-shaped configuration, with their axes 41 surrounding the rail head 39 together with the track rollers 25 at an acute angle.

As shown in FIG. 7, the joint 54 is formed as a length compensation unit 14 by which a shift of the frame structures 56, 57 of the machine frame 5 transversely to the direction of the track 4 is allowed when the carrier frame 6 together with the grinding unit 26 swings about the pivot axis 21 upon actuation of the swivel drive 32. The length compensation unit 14 includes four links 55 which are rotatably connected to each other about vertical axes 58 to define a parallelogram lying in a horizontal plane. A spring 59 extends longitudinally in direction of the track 4 to bridge two points of attachment of the respective links 55 so as to prestress the length compensation unit 14. During positional change of the grinding unit 26 in direction of arrow 70, the frame structure 57 shifts in direction of arrow 71, i.e. transversely to the track 4 so that the spring 59 is extended in direction of arrows 72 to operate as a pressure-exerting element which exerts via the links 55 and the frame structure 57 a force by which the grinding unit 26 is pressed against the inside rail head flank 46 of the rail 3.

It will be understood by persons skilled in the art, that it is certainly within the scope of the present invention to employ any suitable grinding units such as e.g. grinding units with rotating grinding wheels or grinding rings as well as with abrasive belt units.

While the invention has been illustrated and described as embodied in a rail grinding machine for grinding rails of a track, it is not intended to be limited to the details shown since various modifications and structural changes may be made without departing in any way from the spirit of the present invention.

We claim:

1. A rail grinding machine for grinding rails of a track, comprising:

a machine frame having first support rollers for mobility on one of the rails of a track;

a carrier frame extending in vicinity of the other one of the rails and swingably mounted to said machine frame for rotation about a horizontal pivot axis which extends longitudinally in direction of the track, said carrier frame having second support rollers for mobility on the other rail, with each said second support roller being formed as a track roller having an axis of rotation which extends perpendicular to the longitudinal direction of the track and to the horizontal pivot axis of said carrier frame;

grinding unit including a grinder adjustably secured to said carrier frame for executing a grinding operation on the rail;

a swivel drive for swingably mounting said carrier frame to said machine frame and effecting rotation of said carrier frame about the pivot axis;

a drive motor secured to said machine frame at a distance to said carrier frame; and a length compensation unit for effecting a reduction of a distance of said carrier frame and said pivot axis from a first support roller situated in opposition to said grinder in a direction transversely to the track, said length compensation unit including a pressure-exerting element for applying in opposition to the distance reduction a force by which said grinder is pressed against an inner rail head flank of the rail.

2. The machine of claim 1 wherein at maximum distance of said carrier frame from said opposing support roller said pivot axis of said carrier frame is arranged outside the rail at a distance from an upper outer rail head edge of the rail in horizontal and vertical directions.

3. The machine of claim 1 wherein said grinder bears upon the rail at a point of contact which lies on a connecting line between contact points formed by a contact of said second support rollers upon the rail.

4. The machine of claim 3 wherein said grinder is formed as a rotating cup wheel having an axis of rotation perpendicular to said connecting line.

5. The machine of claim 1 wherein said machine frame includes two frame structures respectively supported on the rails, said frame structures being connected to each other by said length compensation unit and being adjustable relative to each other in direction transversely to the track.

6. The machine of claim 5 wherein one of said frame structures is arranged at a distance to said carrier frame and supported by a support roller in the form of a double-rimmed roller.

7. The machine of claim 5 wherein said length compensation unit includes a support member extending in direction transversely to the track, said support member being secured to one of said frame structures of said machine frame and adjustably mounted in longitudinal direction relative to said other one of said frame structures, said pressure-exerting element being formed as a helical spring which is compressed during distance reduction and arranged between both frame structures.

8. The machine of claim 1, further comprising a guide roller associated to each of said track rollers on the rail, said guide roller being secured to said carrier frame and rotatable about an axis which extends at an angle relative to the axis of rotation of said track roller and is perpendicular to the pivot axis of said carrier frame.

9. The machine of claim 8 wherein said guide roller has a rim for bearing upon an outer rail head edge at a distance to said track roller.

10. The machine of claim 8 wherein the axis of rotation of said track roller and the axis of said guide roller define an angle of 45°.

11. The machine of claim 1 wherein said swivel drive is a hydraulic drive articulated to said machine frame and said carrier frame.

12. The machine of claim 1, further comprising a remote-controlled actuating drive for adjusting said grinder on said carrier frame in a direction perpendicular to the pivot axis toward the rail being ground.

13. The machine of claim 1 wherein said machine frame has an upwardly projecting U-shaped stand for attachment of control elements for said drive motor and said grinding unit.

14. A rail grinding machine for grinding rails of a track, comprising:

a machine frame extending across the track and having a first frame assembly having first support rollers for mobility along one of the rails of a track, and a second frame assembly extending in vicinity of the other one of the rails and having second support rollers for mobility on the other rail, said second frame assembly being swingable about a horizontal pivot axis which extends longitudinally in direction of the track, with each said second support roller being defined by an axis of rotation which extends perpendicular to the longitudinal direction of the track and to the pivot axis of said second frame assembly;

a grinder adjustably secured to said second frame assembly for executing a grinding operation on the rail;

a swivel drive swingably mounting said second frame assembly to said first frame assembly for effecting swinging of said second frame assembly about the pivot axis between a first end position for grinding a running surface of the rail and a second end position for grinding an inner rail head flank of the rail; and a length compensation unit integrated in said machine frame for allowing a length reduction of said machine frame across the track during swinging of said second frame assembly into the second position, said length compensation unit including a pressure-exerting element for applying a force in opposition to the length reduction to press said grinder against the inner rail head flank of the rail.

15. The machine of claim 14 wherein the pivot axis of said second frame assembly is arranged in the first end position outside the rail at a distance from an upper outer rail head edge of the rail in horizontal and vertical directions.

16. The machine of claim 14 wherein said grinder bears upon the rail at a point of contact which lies on a connecting line between contact points formed by a contact of said support rollers upon the rail.

17. The machine of claim 16 wherein said grinder is formed as a rotating cup wheel having an axis of rotation perpendicular to said connecting line.

18. The machine of claim 14 wherein said first frame assembly includes two frame structures which are connected to each other by said length compensation unit and adjustable relative to each other in direction transversely to the track.

19. The machine of claim 14 wherein said first support rollers of said first frame assembly are double-rimmed rollers.

20. The machine of claim 14 wherein said pressure-exerting element is a helical spring which is compressed during length reduction of said machine frame across the track.

21. The machine of claim 14, further comprising holding means for securing said machine frame in the second end position, said holding means being secured to said second frame assembly and extending at an angle to an axis of rotation of said second support rollers and perpendicular to the pivot axis of said second frame assembly.

22. The machine of claim 21 wherein said holding means includes a guide roller adjacent each second support roller on the rail and having a rim for bearing upon an outer rail head edge at a distance to said second support roller.

23. The machine of claim 22 wherein the axis of rotation of said second support roller and the axis of said guide roller define an angle of 45°.

24. A rail grinding machine, comprising:

a machine frame extending across a track and having a first frame assembly supported on first rollers for mobility along one rail of the track, and a second frame assembly supported on second rollers for mobility along the other rail of the track and swingably mounted to said first frame assembly for rotation about a pivot axis which extends longitudinally in direction of the track between two end positions to selectively allow grinding of a running surface and grinding of an inner rail head flank of the rail, with each said second support roller being defined by an axis of rotation which extends perpendicular to the longitudinal direction of the track and to the pivot axis of said second frame assembly;

a grinder secured to said second frame assembly of said machine frame for executing a grinding operation on the rail; and a length compensation unit integrated in said machine between said first and second frame assemblies for adjusting the length of said machine frame across the track when said second frame assembly moves between said end positions, said length compensation unit including a pressure-exerting element for applying a force in opposition to the length adjustment when said first frame assembly occupies the end position for grinding the inner rail head flank of the rail in order to press said grinder against the inner rail head flank of the rail.

* * * * *